US008286841B2

(12) United States Patent
Louw

(10) Patent No.: US 8,286,841 B2
(45) Date of Patent: Oct. 16, 2012

(54) HANGER ARRANGEMENT AND INDICATOR DEVICE FOR USE THEREIN

(75) Inventor: Henry John Louw, Bergvliet (ZA)

(73) Assignee: Polyoak Packaging (Pty) Ltd., Cape Town (ZA)

( * ) Notice: Subject to any disclaimer, the term of this patent is extended or adjusted under 35 U.S.C. 154(b) by 0 days.

(21) Appl. No.: 11/635,461

(22) Filed: Dec. 6, 2006

(65) Prior Publication Data

US 2007/0187439 A1 Aug. 16, 2007

(30) Foreign Application Priority Data

Dec. 6, 2005 (ZA) ..... 2005/09874

(51) Int. Cl.
*A41D 27/22* (2006.01)

(52) U.S. Cl. ..... 223/85; 40/322

(58) Field of Classification Search ..... 223/85, 223/88, 92, 95; 40/322; D6/328
See application file for complete search history.

(56) References Cited

U.S. PATENT DOCUMENTS

| | | | | | |
|---|---|---|---|---|---|
| 4,881,836 | A * | 11/1989 | Blanchard | 40/322 |
| 4,997,114 | A * | 3/1991 | Petrou | 223/85 |
| 5,096,101 | A * | 3/1992 | Norman et al. | 223/85 |
| 5,586,697 | A * | 12/1996 | Johansson | 223/85 |
| 5,683,018 | A * | 11/1997 | Sullivan et al. | 223/85 |
| 6,041,983 | A * | 3/2000 | Sullivan et al. | 223/85 |
| 7,287,674 | B1 * | 10/2007 | Sutton et al. | 223/85 |
| 2004/0211796 | A1 * | 10/2004 | Misumi | 223/85 |
| 2006/0213938 | A1 * | 9/2006 | Gouldson | 223/85 |
| 2007/0257071 | A1 * | 11/2007 | Gouldson | 223/85 |

* cited by examiner

*Primary Examiner* — Nathan Durham
(74) *Attorney, Agent, or Firm* — Ostrolenk Faber LLP

(57) ABSTRACT

A hanger arrangement in accordance with an embodiment of the present application includes a hanger including a hanger body, a hook member and a peripheral rib extending outward from the hanger body and the hook member and an indicator device removably attached on a side of the hanger body at a point where the hanger body and the hook member join, the indicator device including locating means associated with the indicator device operable to attach the indicator device to the peripheral rib of the hanger such that the indicator device is secured at the point where the hanger body and the hook member join. The locating means may include at least one abutment member extending partially into the groove and structured to fit against the hanger body, a stub structured to clip over the peripheral rib of the hanger.

2 Claims, 2 Drawing Sheets

HANGER ARRANGEMENT AND INDICATOR DEVICE FOR USE THEREIN

CROSS REFERENCE TO RELATED APPLICATION

The present application claims benefit of and priority to South African Patent Specification ZA 2005/09874 entitled HANGER ARRANGEMENT filed Dec. 6, 2005, the entire contents of which are hereby incorporated by reference herein.

BACKGROUND OF THE INVENTION

1. Field of the Invention

The present invention relates to a hanger arrangement for a garment hanger including an indicator for indicating a size of a garment supported by the garment hanger.

2. Related Art

Garment hangers are often provided with indicators for indicating a size of a garment supported on the hanger. These indicators are normally provided either on a hook or a central neck portion of the hanger and are thus visible from the front or back of the garment hanger.

Garment hangers used for lingerie, generally referred to as intimate hangers by retailers, are often required to have the size indicator clip onto the side of the hanger neck. Such side clip-ons require a web projecting between the hanger neck and the hanger shoulder for attachment of the indicator. This creates a visually unattractive hanger when the indicator is not attached to the hanger and thus effectively eliminates the use of the hanger in retail without the indicator.

It would be beneficial to provide a hanger arrangement that avoids these problems.

SUMMARY OF THE INVENTION

It is an object of the present invention to provide a hanger arrangement which will assist in overcoming the problems described above.

A hanger arrangement in accordance with one embodiment of the present invention includes a hanger including a hanger body, a hook member and a peripheral rib extending from the hanger body and the hook member, and an indicator device removably attached on a side of the hanger body at a point where the hanger body and the hook member join, the indicator device including locating means operable to attach the indicator device to the peripheral rib to secure the indicator device at the point where the body and the hook join.

The hook member may be integrally formed with the hanger body.

The peripheral rib may be an integrally formed strengthening rib.

The indicator device may include an indicator body with two spaced apart substantially parallel side walls extending from the indicator body to define a groove.

The side walls may be resiliently flexible relative to the indicator body.

The locating means may project from at least one side wall into the groove.

The locating means may include abutment members provided within the groove being adapted to fit against the hanger body, and a stub being adapted to clip over the peripheral rib.

The abutments members may be ridges shaped correspondingly to a shape of the hanger body.

The indicator device may have an outer display surface being adapted to display information such as a size measurement or price of a garment.

The indicator device may be substantially triangular.

An indicator device in accordance with an embodiment of the present invention includes a indicator body, two spaced apart substantially parallel side walls extending from the indicator body defining a groove and locating means adapted to be attached to a peripheral rib extending from a hanger body.

The locating means may include abutment members provided within the groove being adapted to fit against the hanger body, and a stub being adapted to clip over the peripheral rib.

The abutment members may be ridges shaped to correspond to a shape of the hanger body.

The side walls may be resiliently flexible relative to the indicator body.

The indicator device may have an outer display surface adapted to display information such as a size measurement or price of a garment.

The indicator device may be substantially triangular.

Other features and advantages of the present invention will become apparent from the following description of the invention which refers to the accompanying drawings.

BRIEF DESCRIPTION OF THE DRAWING(S)

DETAILED DESCRIPTION OF PREFERRED EMBODIMENTS OF THE INVENTION

Since hangers are typically repeatedly used with different sized garments, the indicators used on the hangers are often removed and replaced with alternate indicators. The indicator of the present invention should thus be easily replaceable but remain securely connected to the hanger to avoid accidental dislodging. Further, keeping the indicators securely fixed to the hangers maintains a uniform and aesthetically pleasing appearance on the rack With reference to FIG. 1, a hanger arrangement 10 in accordance with an embodiment of the present invention includes a hanger 12 to which a removable indicator device 14 is joined or attached.

Figure 1:
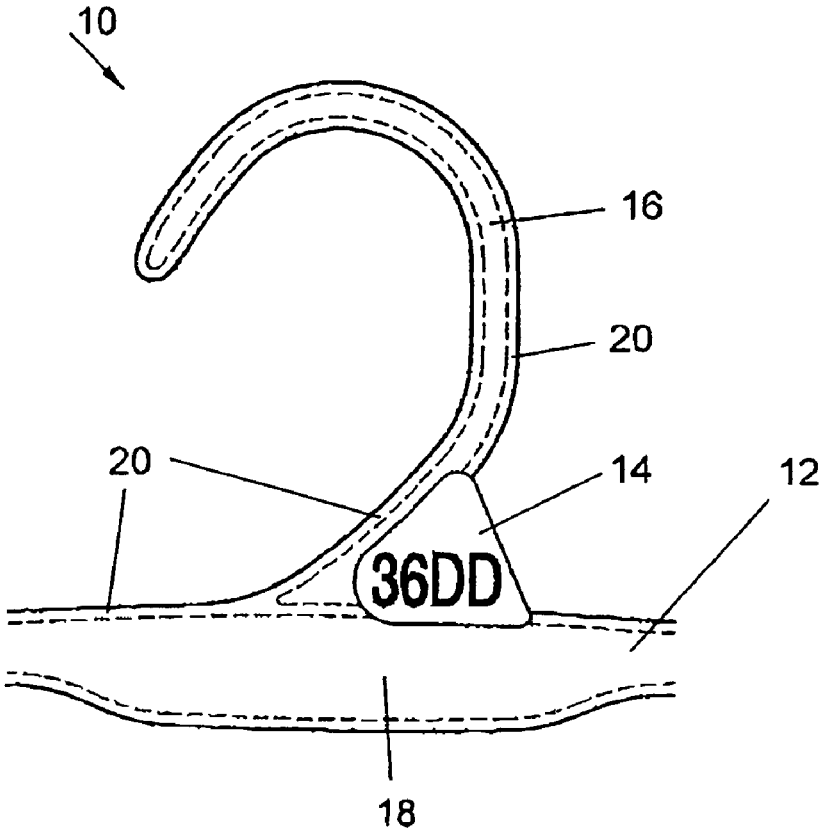
FIG. 1 is a front view of a hanger arrangement in accordance with an embodiment of the present application

The hanger 12 preferably includes an integrally formed hook 16 extending centrally from a neck 18 (or body) of the hanger 12. The hook 16 and neck 18 have peripheral strengthening ribs 20 extending outwardly towards the rear of the hanger. In this case, the "rear" refers to the side of the hanger 12 that will normally be hidden from a customer's view when an item of clothing is hung on the hanger. The ribs 20 are illustrated in dotted lines in FIG. 1, since FIG. 1 is a front view of the hanger arrangement 10. The hook 16 may take any suitable shape, and may be joined to the neck 18 at an angle as illustrated in FIG. 1 or substantially perpendicularly.

As illustrated in FIGS. 2-5, the indicator device 14 preferably includes a substantially triangular body 22 formed by two spaced apart parallel side walls 24, 26 joined for about half the width of the body 22 by a central trapezoidally shaped buttress 28 so that a groove 30 is formed between the remainder of the side walls 24, 26. The buttress 28 is formed flush with the edges 34, 36 so that the side walls 24, 26 project beyond the buttress 28.

Locating means in the form of ridges 38,40 may be provided on the side walls 24, 26 partially in the groove 30. The ridges 38, 40 support the side walls 24, 26 but allow them to resiliently flex outwardly for attachment to the hanger 12 while maintaining sufficient stability to prevent them from breaking away from the buttress 28. The body 22 is preferably shaped to correspond to the shape of the hanger 12 at the point where the neck 18 and the hook 16 are joined so that when located next to the hanger 12, the ridges 38, 40 and buttress 28 lie snugly against the neck 18 and the hook 16 while the side walls 24, 26 slightly overlap the neck 18 and the hook 16.

Figure 2:
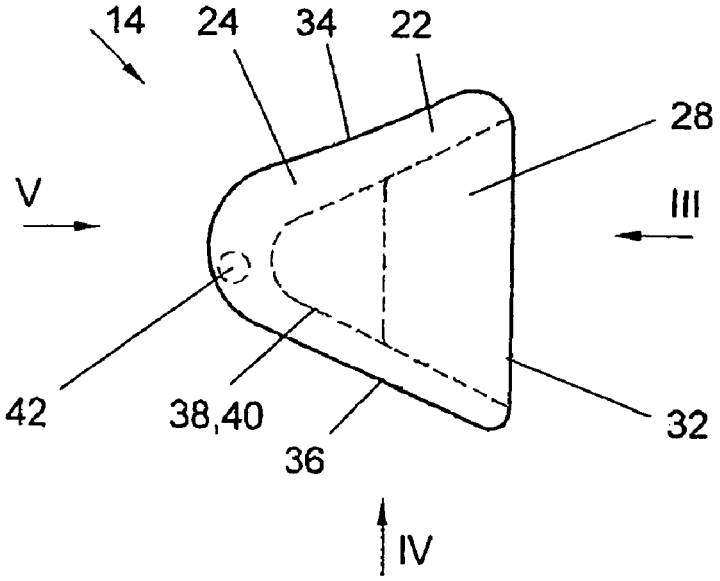
FIG. 2 is a front view of an indicator device in accordance with an embodiment of the present application.
Figure 3:
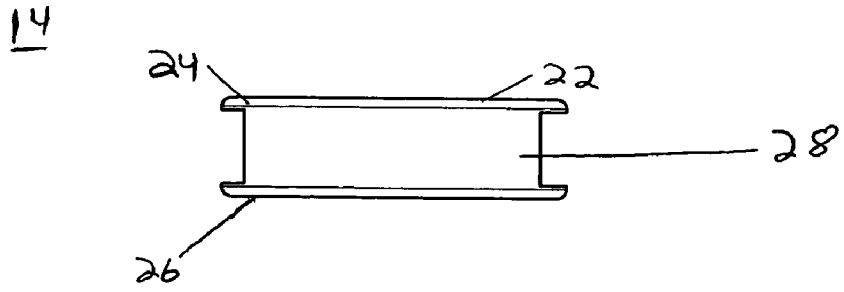
FIG. 3 is an end view of the indicator device of FIG. 2 seen along arrow III.
Figure 4:
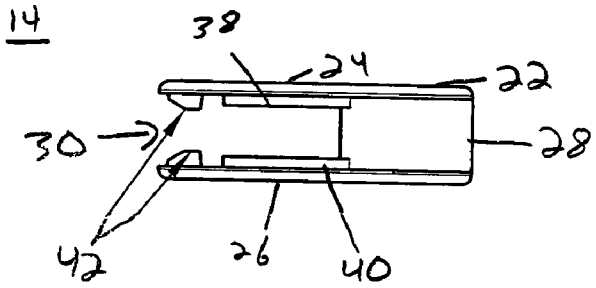
FIG. 4 is a side view of the indicator device of FIG. 2 seen along arrow IV.
Figure 5:
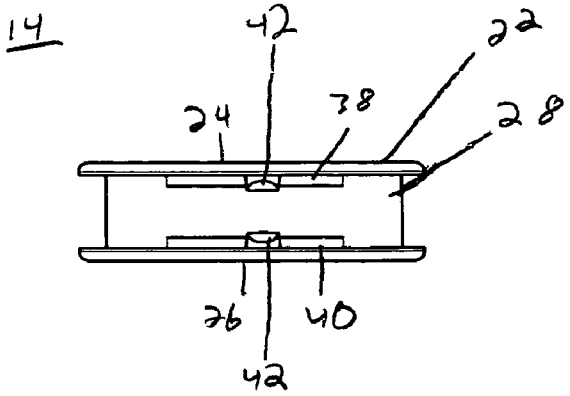
FIG. 5 is an end view of the indicator device of FIG. 2 seen along arrow V.

The body 22 is preferably provided with at least one stub 42 extending inwardly into the groove 30 near the vertex of edges 34, 36 of the sidewalls 24, 26. The stub 42 is spaced away from the ridges 38, 40 and is adapted to clip over the rib 20 of the hook member 16 (or neck 18, if desired) to retain the indicator device 14 in position on the hanger 12. The buttress 28, ridges 38,40 and stub 42 interact to prevent movement of the indicator device 14 along the neck 18 or the hook 16, while the overlapping of the side walls 24, 26 keeps the indicator device 14 snugly fitted to the hanger 12. As illustrated in FIGS. 2 and 3, two stubs 42 may be provided to extend into the groove 30 from the sidewalls 24, 26, respectively, if desired.

In a preferred embodiment, information such as a size measurement of a garment may be displayed on the outer surfaces of the side walls 24, 26 and the buttress 28 of the indicator device 14. If desired, other information may also be displayed here as well, for example, advertising information, price information or any other desired information.

After a garment is sold and removed from the hanger, the indicator device 14 can be removed and attached to a new hanger similar to hanger 12.

The indicator device 14 is preferably made of a plastic material or any other suitable material including resilient metals if desired. If made of plastic, injection molding may be a convenient way to form the indicator 14, however, any suitable method of manufacture may be used.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A hanger arrangement comprises:

a hanger including a first face on a front side of the hanger, a second face opposite the first face on a rear side of the hanger, a hanger body, a hook member and a peripheral rib extending rearward from the rear side of the hanger body and the hook member, the peripheral rib having a constant shape; and an indicator device removably attached on a lateral side of the hanger body between the front side and the rear side at a point where the hanger body and the hook member join, such that the entire indicator is positioned on the lateral side of the hanger body, the indicator device including a locator associated with the indicator device operable to attach the indicator device to the peripheral rib of the hanger such that the indicator device is secured at the point where the hanger body and the hook member join;

the locator further including:

at least one abutment member extending partially into a groove of the indicator device and structured to fit against the hanger body; and a stub structured to clip over the peripheral rib of the hanger.

2. An indicator device for use with a hanger including a first face on a front side of the hanger and a second face opposite the first face on a rear side of the hanger, a hanger body and a hook member, the indicator device comprises:

an indicator body;

two spaced apart substantially parallel side walls extending from the indicator body defining a groove; and a locator configured and operable to be attached to a peripheral rib extending rearward from the rear side of the hanger body and the hook member of the hanger, the peripheral rib having a constant shape, to secure the indicator device to the hanger such that the indicator device is removably attached on a lateral side of the hanger body between the front side and the rear side at a point where the hanger body and the hook member join, the entire indicator positioned on the lateral side of the hanger;

the locator further including:

at least one abutment member extending partially into the groove and structured to fit against the hanger body; and a stub structured to clip over the peripheral rib of the hanger.

* * * * *